United States Patent [19]

Ramey

[11] 4,279,548

[45] Jul. 21, 1981

[54] HYDRAULIC PROPULSION UNIT

[76] Inventor: Raymond W. Ramey, P.O. Box 220, Bellaire, Tex. 77401

[21] Appl. No.: 14,111

[22] Filed: Feb. 22, 1979

[51] Int. Cl.[3] ..... E21D 7/00

[52] U.S. Cl. ..... 405/283; 37/189; 405/282

[58] Field of Search ..... 405/282, 283, 272, 284, 405/281, 141, 142; 37/189

[56] References Cited

U.S. PATENT DOCUMENTS

| | | | |
|---|---|---|---|
| 1,149,937 | 8/1915 | Murphy | 405/283 X |
| 3,214,919 | 11/1965 | Kusatake | 405/283 X |
| 3,461,579 | 8/1969 | Turner | 37/189 |
| 3,473,243 | 10/1969 | Turner | 37/189 |
| 3,593,528 | 7/1971 | Pavese | 405/282 |
| 3,608,319 | 9/1971 | Quitadamo | 405/283 |
| 3,750,409 | 8/1973 | Orfei | 405/283 |
| 3,820,345 | 6/1974 | Brecht | 405/283 |
| 3,916,629 | 11/1975 | Thompson | 405/283 |
| 3,967,463 | 7/1976 | Grandori | 405/141 |
| 4,060,992 | 12/1977 | Heitkamp et al. | 405/283 |
| 4,094,152 | 6/1978 | Jutte | 405/283 X |

FOREIGN PATENT DOCUMENTS

| | | | |
|---|---|---|---|
| 1955513 | 5/1971 | Fed. Rep. of Germany | 405/283 |

*Primary Examiner*—Dennis L. Taylor
*Attorney, Agent, or Firm*—David M. Ostfeld

[57] ABSTRACT

An apparatus and a method for excavating and pile reinforcing trenches which requires the removal of, and access to, no more top soil than is defined by the actual dimensions of the ditch. A box-like central structure serves as a frame within which excavation by customary means, e.g., externally positioned hoes, takes place. The outside walls of said central structure form temporary trench walls supporting the surrounding dirt. The inside walls of said central structure form a rear section, narrower in width than the front section and set off therefrom in a step-like fashion, behind which flat piling is driven in before the entire unit advances. Advancement is carried out by means of lateral anchoring base and a longitudinal propulsion mechanism both riding on a trolley structure extending from the rear of the box frame and alternatively expanding and contracting periodically. In addition, vertical shafts with cutting teeth are disposed within the front edges of the box frame walls to facilitate tunneling forward during the propulsion cycle.

15 Claims, 6 Drawing Figures

HYDRAULIC PROPULSION UNIT

TECHNICAL FIELD

This invention relates to the excavation of ditches or trenches and to their reinforcement by piles or other wallforming means.

BACKGROUND ART

In most trenching operations in soft soil the cross section of the excavation area turns out to be of generally trapezoidal shape. Although the hoe or similar excavation means will initially remove only a rectangular section of soil, almost invariably the upper edges of the trench so dug will then cave in and leave the trapezoidal form mentioned above. A wider horizontal section of soil is therefore customarily removed from the top than is required by the dimensions of the bottom of the trench. The same phenomenon necessitates the use of substantial areas outside and alongside the trench for positioning pile driving means in order to reinforce the walls of the excavated ditch. Since such piling is usually driven in perpendicular to the bottom of the trench, the top section of each pile is freestanding and not supported by the surrounding soil. It must therefore be driven in a substantial distance beyond the bottom of the trench in order to assure the required structural rigidity for the sidewalls thus formed.

There are many situations, however, where the room for operating trenching and piling equipment is severely restricted, both horizontally and, possibly, even vertically, be it because of problems of access and right-of-way or because of geological conditions. In such circumstances the desirability of digging and reinforcing trenches with truly vertical sidewalls and with a minimum of lateral surface access requirements has long been recognized by the industry. It is the object of the present invention to satisfy this long felt need with the help of a hydraulic self-advancing excavation unit which requires the removal of, and access to, no more soil than is actually defined by the dimension of the trench.

DISCLOSURE OF INVENTION

The present invention provides a trenching device for use in preparing for the excavation of ditches and for subsequently reinforcing the sidewalls of the ditches, to be used in conjunction with a hoe or similar excavation mechanism and for use in conjunction with a pile driving apparatus for inserting piles along the walls of the ditch. The trenching device of the present invention comprises an excavation box consisting of the metal sidewalls connected by the spacer bars with excavation means mounted inside the front edges of these sidewalls, propulsion means mounted on one of the spacer bars for advancing the excavation box, and anchoring means for bracing the excavation means against the walls of the already excavated portion of the ditch. The anchoring means, when biased against the sidewalls, provide the base support for propelling the excavation box forward through the expansion of the hydraulic propulsion means combined with the action of the cutting means disposed along the front edges of the sidewalls. Initially, however, no more than the thickness of the sidewalls is excavated as the box advances. The bulk of the soil between the sidewalls is then scooped up by customary digging means positioned outside or in front of the submerged excavation box. Pilings are driven in as the box advances right behind, i.e., inside of the sidewalls of the excavation box, and are subsequently pushed flush against the earth walls behind the box through the application of the anchoring means once the entire box has advanced enough to remove the thin sidewall end skirt separating the piling from the excavation walls. Advancing the box is facilitated through a trolley beam along which alternatingly the excavation box can slide forward, pushed by expanding the propulsion means, with respect to the anchoring base and the anchoring means is pulled forward with respect to the stationary excavation box during the contraction cycle of the propulsion means. This invention is described to some extent in the "Abstract of the Invention" which is attached hereto and incorporated herewith by reference.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

BEST MODE FOR CARRYING OUT THE INVENTION

Figure 1:
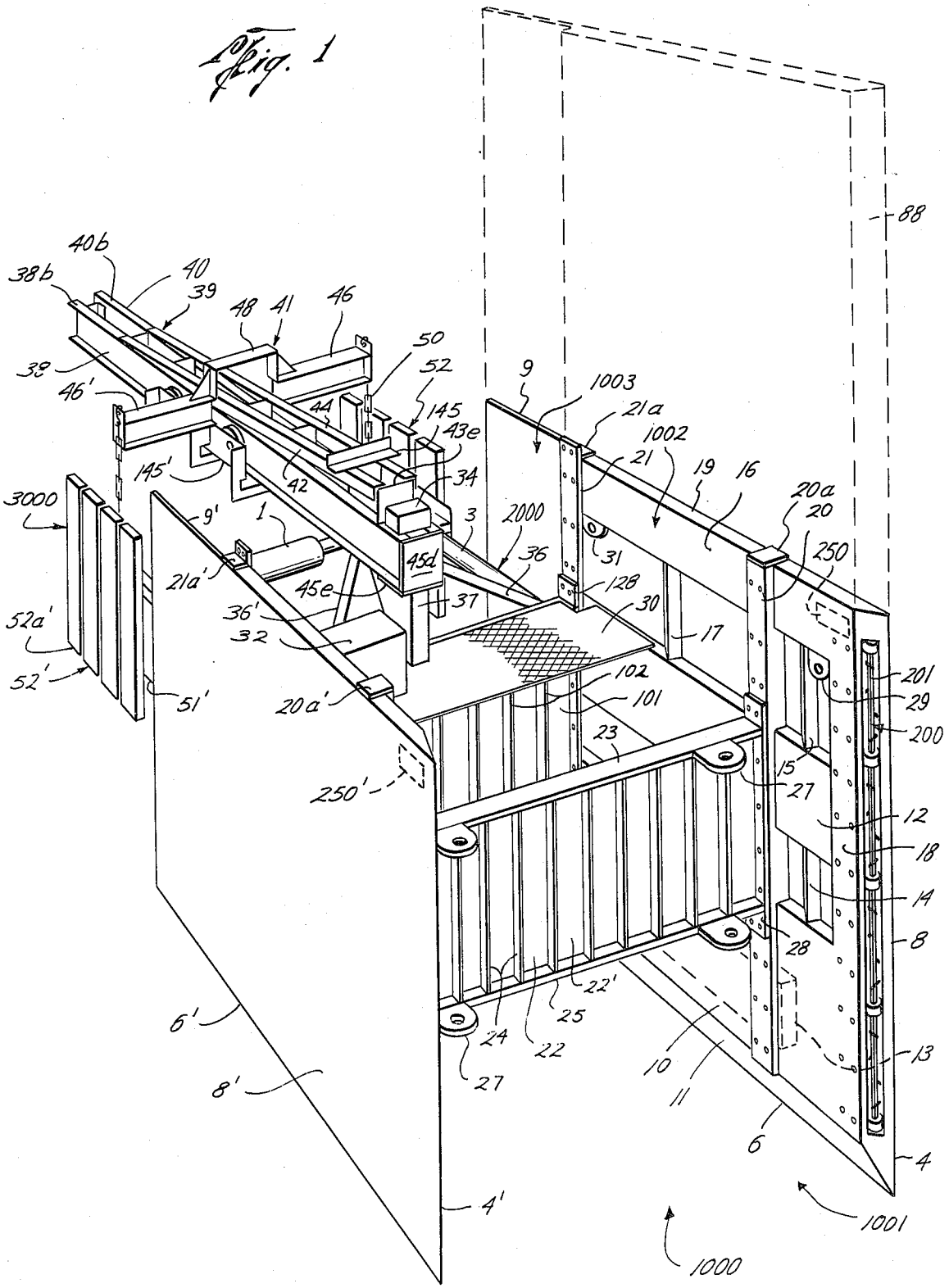
FIG. 1 is a perspective view of the preferred embodiment of the hydraulic propulsion unit of the present invention.
Figure 3:
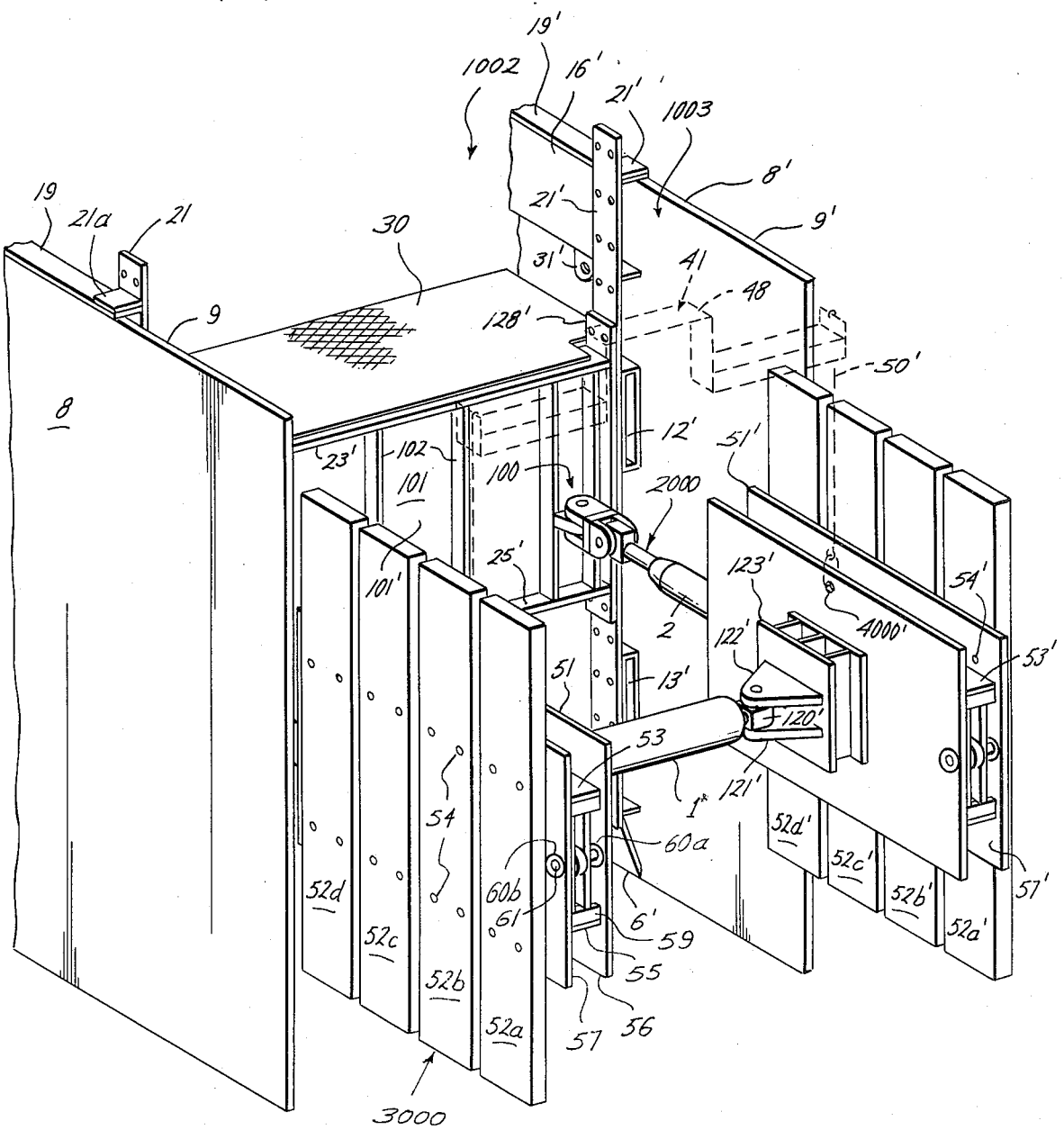
FIG. 3 is a perspective fragmentary view of the rear section of the preferred embodiment of the hydraulic propulsion unit of the present invention.

Referring now to FIGS. 1 and 3, the entire propulsion unit can be seen to comprise three major components: an excavation box 1000, propulsion means 2000 and anchoring means 3000. The excavation box 1000 includes sidewalls 8 and 8', a front spacer bar 22, a rear spacer bar 101 (FIG. 3), a platform 30, cutting edges 4 and 4' and pile skirts 9, and 9'.

The side walls 8,8', front spacer bar 22 and rear spacer bar 101 divide the excavation box 1000 into three main sections: a front section 1001 within which cutting or excavation means are either located or applied, a midsection 1002 comprising control means and power plants, and a rear section 1003 (FIG. 3) within which pile reinforcement of the excavated ditch takes place. The front section 1001 is bounded by front spacer bar 22 and the portion of side walls 8,8' between front spacer bar 22 and cutting edges 4 and 4' of sidewalls 8 and 8', respectively. The midsection 1002 is bounded by front spacer bar 22, rear spacer bar 101 and the portion of sidewalls 8,8' between front spacer bar 22 and rear spacer bar 101. The rear section is bounded by rear spacer bar 101 and the portion of sidewalls 8,8' between rear spacer bar 101 and outer edge of pile skirts 9,9'.

In the preferred embodiment, front spacer bar 22 and rear spacer bar 101 are constructed of steel in the shape of an I-beam. Front spacer bar 22 has top flange 23, bottom flange 25, steel plate 22' and a multitude of stiffeners 24 welded onto the front of bar 22 between top flange 23 and bottom flange 25. Both top flange 23 and bottom flange 25 are equipped with two pulling eyes on the front side of spacer bar 22, generally denoted by reference numeral 27. Pulling eyes 27 are adapted to connect to fastening means (not shown), such as hooks, cables or chains if it becomes necessary or desirable to pull the propulsion unit, e.g., when an impasse is encountered. Similar vertical lift eyes 29, 29' and 31, 31' are also provided on the upper side panels 16 and 16' of the interior portions of sidewalls 8 and 8', respectively, for attaching suitable pulling means should it become necessary or desirable to lift the entire propulsion unit. Front spacer bar 22 also includes side flanges 28 and 28' welded onto the web or centerpiece of front spacer bar 22 at either end and extending somewhat above top flange 23 as well as below bottom flange 25. Side flanges 28 and 28' are provided with numerous evenly spaced pairs of generally circular openings for receiving bolts adapted to attach front spacer bar 22 to the sidewalls 8, 8' of the excavation box 1000. Attachment is accomplished by attachment of side flanges 28, 28' to anterior vertical struts 20, 20' discussed infra. Rear spacer bar 101 has top flange 23', bottom flange 25', steel plate 101' and a multitude of stiffeners 102 welded onto the front of bar 101 between top flange 23' and bottom flange 25'. Rear spacer bar 101 also includes side flanges 128 and 128' welded onto the web or centerpiece of rear spacer bar 101 at either end and extending somewhat above top flange 23' as well as below bottom flange 25'. Side flanges 128 and 128' are provided with numerous evenly spaced pairs of generally circular openings for receiving bolts adapted to attach rear spacer bar 101 to the sidewalls 8, 8' of the excavation box 1000. Attachment is accomplished by attachment of side flanges 128 and 128' to posterior vertical struts 21, 21' discussed infra.

In the preferred embodiment of the present invention, the side sections of excavation box 1000 are symmetrical with respect to the center axis of spacer bar 22. Therefore only one such section shall be described in detail, it being understood that, unless expressly noted otherwise, there exists a corresponding counterpart, indicated by a corresponding primed reference numeral, to every part referred to in the following description. Exterior sidewall 8 is a generally rectangular, flat plate of steel with cutting edges 5 and 6 at the front and bottom, respectively. Two side panels 10, 16 and two reinforcement channels 12, 13 are fastened, e.g., by welding, along the interior surface of side wall 8, top side panel 16, center reinforcement channel 12, lower reinforcement channel 13 and lower side panel 10 are parallel to one another and extend from front edge 4 to posterior vertical strut 21. Top side panel 16 is connected at its top to the outer flat plate on side wall 8 by cover plate 19. Front cover panel 18 extends from the end of panels 10, 16 and channels 12, 13 to edge 4.

Posterior vertical strut 21 is located at the boundary between rear section 1003 and midsection 1002 adjacent to side flange 128. Similarly anterior vertical strut 20 is located at the boundary between front section 1001 and midsection 1002 adjacent to side flange 28. Both vertical struts 20, 21 are in the form of structural tees with top plates **20*a* and 21*a* respectively welded onto their upper end portions so as to join them with sidewall top cover plate 19. The protruding T-flanges of both anterior and posterior vertical struts 20, 21 are perforated with a number of pairs of circular openings on either side of the center web of vertical struts 20, 21. These circular openings are provided at certain intervals so as to receive releasable fasteners, such as head bolts, for releasably attaching side flanges 28 and 128 of front and rear spacer bars 22, 101 respectively to anterior and posterior vertical struts 20 and 21 respectively. Both spacer bars could thus be raised and lowered independently, if desired, along their respective vertical struts. Similar pairs of circular openings are also provided along vertical front cover panel 18 for either moving front spacer bar 22 forward to that position or for providing an additional, third spacer bar, if desired, between the cutting edges of the excavation box 1000**.

The central reinforcement channel 12 and lower reinforcement channel 13 each includes two segments of hollow, rectangular channel pieces, the first running between the vertical front panel 18 and the front vertical strut 20 and the second running between the front vertical strut 20 and rear vertical strut 21. These sections are attached, for example by welding onto the inside of sidewall 8 and are connected, in a similar fashion, with panel 18, struts 20 and 21, so as to provide lateral structural rigidity to the excavation box 1000. Lower reinforcement channel 13 or 13' is covered by lower side panel 10. Lower side panel 10 extends downwardly to within approximately one foot of the bottom edge 6 of sidewall 8. At that point, lower side panel 10, front vertical panel 18 and vertical struts 20 and 21 are joined by welding or other suitable connection to a cutting panel 11 which tapers down to bottom cutting edge 6 of the excavation box 1000. To further enhance structural rigidity, triangular reinforcement trusses 14, 15 are attached by welding or other suitable connection onto the inside of sidewall 8. Triangular reinforcement truss 15 joins together upper side panel 16 and center reinforcement channel 12. Triangular reinforcement truss 14 joins together center reinforcement channel 12 and lower side panel 10. As shown in FIG. 1, similar trusses are also found in the midsection where platform 30 is located.

Figure 2:
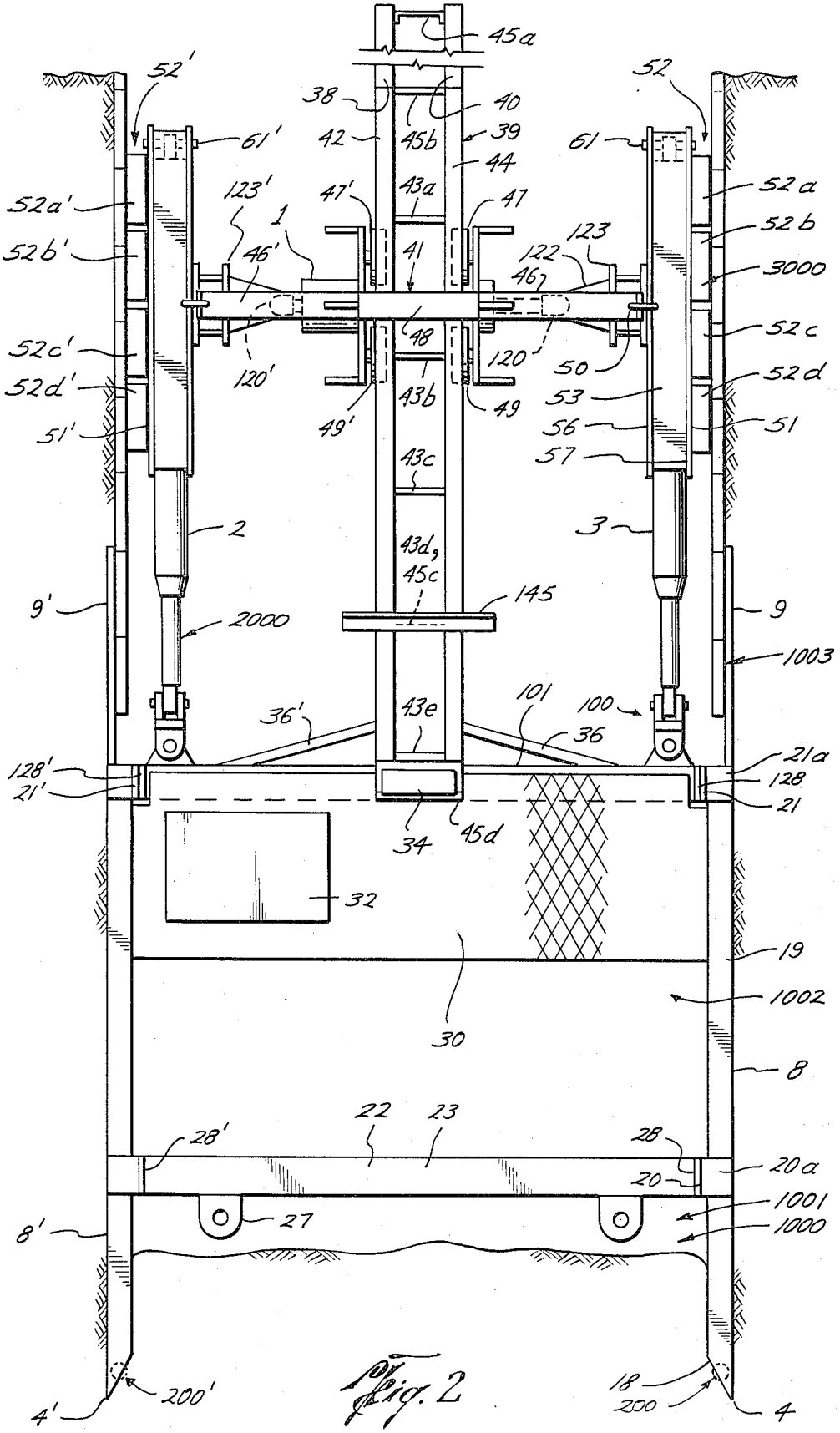
FIG. 2 is a top plan view of the apparatus of FIG. 1.

Referring to FIGS. 1–3, a flat, rectangular metal platform 30 is shown which rests upon the upper flange 23' of rear spacer bar 101 and is bolted thereto. Platform 30 also rests upon the upper edges of center reinforcement channels 12 and 12'. Central power plant 32 for the hydraulic system of the propulsion unit is located on platform 30. A control panel 34 atop trolley boom 39 discussed infra permits a human operator (not shown) to activate and operate propulsion cylinders 2 and 3, anchor cylinder 1 and front excavation means 200 discussed infra from platform 30.

The distance along the sidewalls 8,8' from the bottom of cutting edge 6 to the top plate 19 is in a range of six to eight feet high. In the preferred embodiment of the present invention another pair of sidewall sections 88, 88', similar in structure and dimensions to sidewall 8 just described, except for cutting edges 6,6', may be placed upon top plates 19, 19' of sidewalls 8, 8' respectively and releasably attached thereto with the help of cover plates, such as those having the shape of cover plates **21*a*, 21*a'* shown in FIG. 1, along vertical struts 20, 20' and 21, 21' as well as front vertical panels 18, 18'. In this fashion the excavation of ditches up to 18 feet in depth is possible while the individual propulsion unit modules retain their features of manageable sizing and easy field transportability. One of these top structures 88' is generally indicated by dotted lines in FIG. 1**.

Referring now to FIGS. 2 and 3, the rear section of the excavation box 1000 is defined by rear vertical struts 21 and 21', near spacer bar 101 and pile skirts 9 and 9'. The pile skirts essentially consist of non-reinforced sections of sidewalls 8 and 8', extending approximately 2–3 feet beyond rear vertical struts 21 and 21'. It is in this section that the flat piles customarily used in the art are driven in by any of the usual means known in the art while the propulsion unit of the present invention advances. It is, therefore, not necessary to interrupt the excavation process and to remove the excavation means in order to insert piles along the sidewalls.

The anchoring means 3000 includes arrays of anchor bases 52, 52' and lateral extension cylinder 1. The anchoring means 3000 required for the continuous mode of operation of the propulsion unit of the present invention are best illustrated in FIG. 3. In the preferred embodiment of the present invention, the anchor bases 51, 51' are symmetrical in structure and function. Therefore, only one such anchor board shall be described in detail, it being understood that, unless expressly noted otherwise, there exists a corresponding counterpart indicated by a corresponding primed reference numeral, to every part referred to in the following description. Anchor board 51' includes a metal base structure and a wooden pressure-bearing exterior grid. In the preferred embodiment of the present invention, the exterior pressure-bearing grid consists of four wooden beams **52*a'*, 52*b'*, 52*c'*, 52*d'* of rectangular cross-section, approximately three to four feet in length and one foot wide. Beams 52*a'*, 52*b'*, 52*c'* and 52*d'* are juxtaposed, spaced apart a couple of inches, and are made of creosote wood. They are releasably attached to outer channel plate 57' of anchor base 51' by means of bolts 54'** and can thus be removed or exchanged when necessary.

Outer channel plate 57' of anchor base 51' is affixed, for example, by welding, to two channel core plates 53' and 55' which, in turn, are attached in a like manner to inner channel plate 56'. Channel plates 56' and 57' are also provided with circular openings **60*a'* and 60*b'*, respectively, located towards the rear center portion of said plates 56', 57'. Pin 61' is inserted into circular openings 60*a'*, 60*b'*. The cylinder portion of a longitudinal propulsion piston/cylinder 2 (or piston/cylinder 3 on the other side) of the propulsion means 2000 is pivotably attached by pin 61' within circular openings 60*a'*, 60*b'*, and is backstopped by channel core backstop 59'. Inner channel plate 56' is also perforated in a top center location 4000' to permit horizontal adjustment means, such as chain 50', to be connected to the anchor means 3000. The piston portion of longitudinal propulsion piston/cylinder 2 (or 3) attaches at its other end to rear spacer bar 101 by means of a gimbal connection 100', positioned between rear side flange 128' and the first of the stiffeners 102 of rear spacer bar 101**.

Anchor bases 51, 51' are connected to each other through lateral extension piston/cylinder 1. To that end, support structures 123 and 123' are affixed, for example, by welding to inner channel plates 56 and 56', respectively. Each such support structure consists of a top brace 122' and a bottom brace 121' with a gimbal connection 120' between them to which either the piston or cylinder of lateral extension piston/cylinder 1 is connected.

Figure 4:
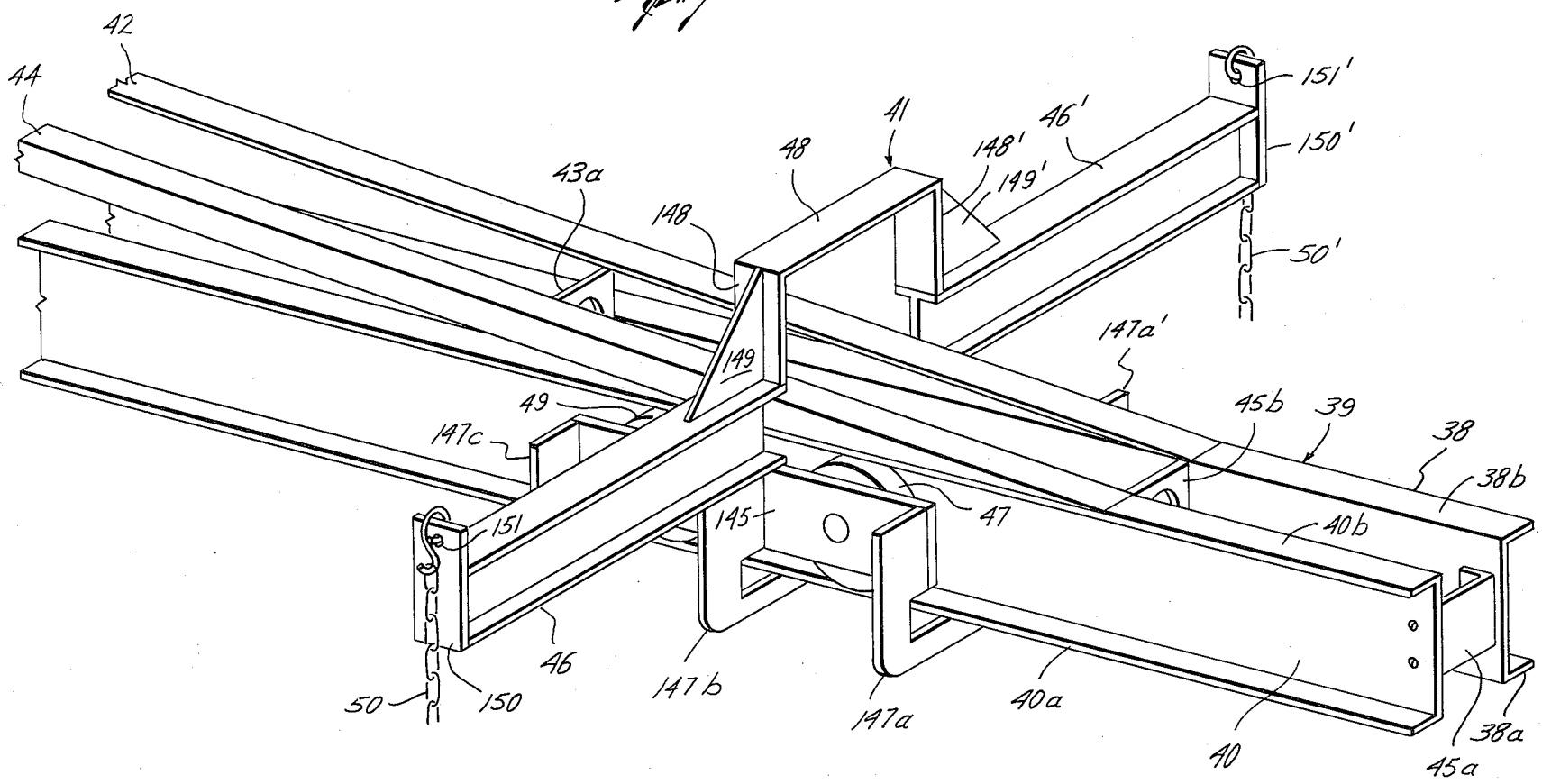
FIG. 4 is a perspective fragmentary view of the trolley support structure of the preferred embodiment of the hydraulic propulsion unit of the present invention.

The propulsion means 2000 includes extension beams 38 and 40, trolley cross beams 46, 46' and longitudinal propulsion cylinders 2 and 3. Referring now to FIGS. 1 and 4, the support structure for the propulsion means 2000 of the preferred embodiment of the present invention can be seen to include a rigidly mounted trolley boom 39 and a movable, trolley-riding, transversal support structure 41. Trolley boom 39 includes two standard channel extension beams 38 and 40, running parallel to one another and rigidly connected to each other, for example by welding, by several connecting braces **45*a*, 45*b*, 45*c*, and 45*d*. In the front section, i.e., in the general area of front brace 45*d*, extension beams 38 and 40 are also joined by a bottom brace 45*e*. Bottom brace 45*e* is removably affixed, for example, by bolts, to platform 30 by means of vertical truss 37 and also by lateral reinforcement trusses 36 and 36' which extend below platform 30 and are braced against rear spacer bar 101. Extension beams 38, 40 are also reinforced on top with angle trusses 42, 44. Said angle trusses are tapered off at one end where they are attached, e.g., by welding, to the top flanges 38*b* and 40*b* of extension beams 38, 40 respectively. From the attachment to top flanges 38*b*, 40*b*, angle trusses 42, 44 incline upwardly to approximately one foot above extension beams 38, 40, respectively, at or near platform 30. Approximately two feet away from platform 30, angle trusses 42 and 44 are both joined, e.g., by welding, to another angle section 145 which also serves as a backstop for the forward movement of trolley support structure 41, in particular the top connector plate 48 thereof described infra. In addition to backstop 145, angle trusses 42 and 44 are also joined together and to extension beams 38 and 40, respectively by auxiliary support frames 43*a*, 43*b*, 43*c*, 43*d* and 43*e*. A small platform is provided on trolley boom 39 behind backstop 145 and end brace 45*d* on which the control panel 34** for all hydraulic connections is located.

Referring to FIG. 4, transversal support structure 41 includes two I-beams 46 and 46' joined together, e.g., by welding, by a top bracket comprising side plates 148, 148', triangular reinforcement sections 149, 149' and top plate 48. I-beams 46, 46' are also joined together, e.g., by welding by a bottom bracket formed by generally U-shaped trolley carriage brace **147*b* which, along its top inner surface is connected to trolley carriage base frames 145 and 145', respectively. Trolley carriage base frames 145 and 145', upon which trolley wheels 47 and 49, 47' and 49', respectively, are rotatably mounted, are also joined at the end by trolley carriage end braces 147*a* and 147*c*. The latter are also of generally U-shaped form and, in the same fashion as center brace 147*b*, are provided with a rectangular slot in the vicinity of the U-bend so as to permit bottom flanges 40*a* and 38*a* of extension beams 40 and 38, respectively, to freely slide therethrough as trolley wheels 47, 49 and 47', 49' advance and recede upon said bottom flanges. I-beam arms 46, 46' are capped off with end plates 150 and 150', respectively, which are affixed to the end portions of said I-beams, e.g., by welding, and are provided with small openings 151, 151' suitable for attaching fastening means, such as chains 50, 50' respectively for supporting, aligning and moving anchor bases 51, 51' to which fastening means 50, 50'** are attached, as shown in FIG. 3.

In a modified version of the preferred embodiment of the present invention, a second set of propulsion means, similar in structure to the one just described, would be placed above first tolley boom 39, e.g., affixed within top box structure 88, 88' in a fashion analogous to the attachment and mode of operation of trolley boom 39, cross beams 46, 46' and anchor boards 51, 51' within bottom excavation box walls 8, 8'. This would provide the entire propulsion unit with one additional degree of freedom in its mode of operation. Unequal expansion of the upper and lower propulsion cylinders will cause a resulting tilt in the alignment of cutting edges 4, 4' with respect to the normal (horizontal) line of advance. In this fashion, excavation depths could be varied continuously as the unit progresses along its path.

Figure 5A:
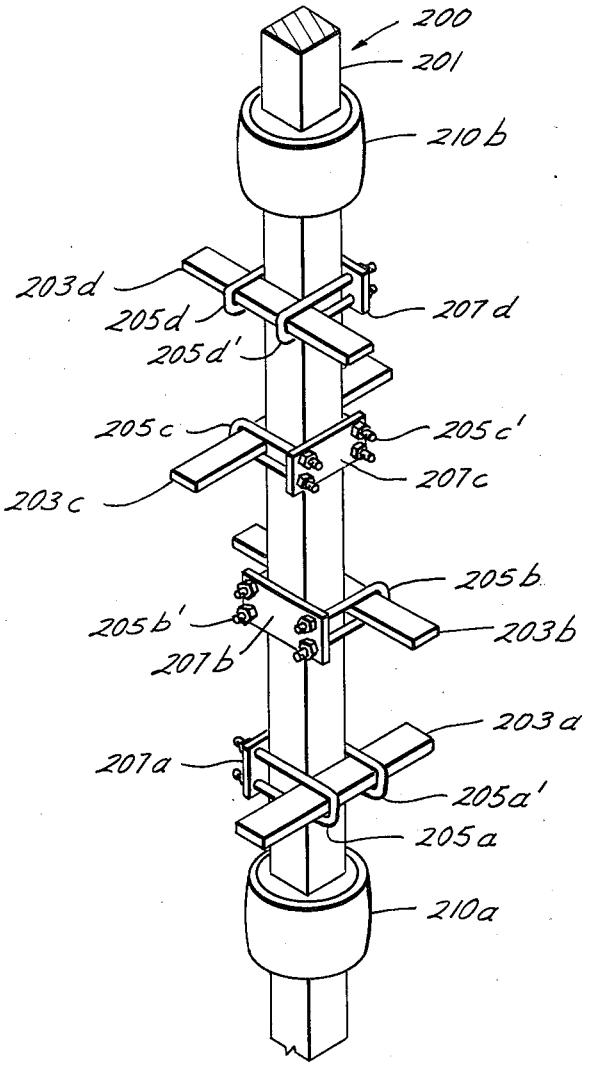
FIG. 5*a* is a fragmentary side elevational view of the cutter assembly of the preferred embodiment hydraulic propulsion unit of the present invention.

Cutting means 200, 200' are mounted within cutting edges 4, 4' (FIG. 1) respectively. Referring now to FIG. 5*a*, cutting means 200 includes a shaft 201, rotatably mounted within a series of bearing-support structures 210*a*, 210*b*, etc., and a number of cutting teeth 203*a*, 203*b*, etc. of steel or other suitable metal. In the preferred embodiment of the present invention, shaft 200 extends all the way from top plate 19 of sidewall 8 down to the bottom edge of lower reinforcement channel 13 within cutting edge 4 and, with the help of suitable connection means is driven by a hydraulic motor 250, in a manner well known in the art. Cutting teeth 203*a*, 203*b*, etc., are preferably of generally rectangular shape and are attached to shaft 200 with 2 U-bolts each, e.g., 205*a* and 205*a'*, bolted to a retainer plate, e.g., 207*a*, located opposite the cutting tooth on the other side of the shaft. The alignment of cutting teeth 203*a*, 203*b*, etc., with respect to one another along the axis of shaft 200 is not uniform, as can be seen from FIG. 5*a*. Rather, each subsequent cutting tooth, retainer plate and U-bolts assembly is rotated with respect to the preceding one by an angle of 90°.

Figure 5B:
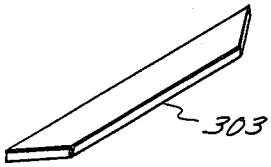
FIG. 5*b* illustrates a different embodiment for the cutting teeth employed on the cutting edge of the apparatus of FIG. 1.

In a slightly modified embodiment of the present invention, the cutting teeth mounted on cutting edge shaft 200 could also be made of generally trapezoidal shape, as depicted in FIG. 5*b*.

In operation, when lateral extension cylinder 1 is expanded, anchor boards 52 are pressed against the already excavated wall portion of the trench thereby providing a temporary support base for absorbing the propelling thrust of longitudinal cylinders 2 and 3. In the initial position the pistons of cylinders 2, 3 are withdrawn into the cylinders whereby anchor boards 52 are laterally locked into place in close proximity to the excavation box 1000. As the pistons of cylinders 2 and 3 expand, the entire excavation box 1000 with its cutting edges 4 and 4' is pushed forward, sliding along extension beams 38 and 40 while trolley cross bars 46, 46' remain virtually stationary with respect to the trench. As edges 4, 4' advance into the soil in front of the trench, cutting teeth 205 bite into the soil permitting the sidewalls of the excavation box to form the boundary of the sides of the trench with as little side space along the trench being used as is absolutely necessary. Keeping pace with the advance of cutting edges 4 and 4', a trench-digger or hoe (not shown) excavates the soil within the space between sides 8, 8' and front spacer bar 22. Subsequently, reinforcing piling, such as interlocking flat plates, are driven into the soil at the bottom of the trench adjacent to the inside surfaces of pile skirts 9, 9' to reinforce the sides of the trench by standard pile driving machinery (not shown) positioned outside the evacuation area. After the reinforcing piling is driven into the side, lateral expansion cylinder 1 and cylinders 2 and 3 are contracted (in that order) so as to permit anchor boards 52 to pass between the driven piles and to be pulled forward towards the excavation box 1000. Once again, cylinder 1 is actuated to force anchor boards 52 firmly against the ditch sidewalls or reinforcing piling.

Although the system described in detail supra has been found to be most satisfactory and preferred, many variations in structures are possible. For example, the height of the excavation box may be adapted to the trenching depth requirements by utilizing the module structure of the basic propulsion unit of the present invention to construct one trencher with multiple units. Also, each individual propulsion unit may be given more degrees of freedom of motion by resorting to multiple anchoring bases and propulsion cylinders. Moreover, the location and arrangement of hydraulic controls as well as the arrangement and construction of the cutting teeth driven by the central hydraulic power system is open to a wide choice of alternatives. The options enumerated above are merely exemplary of the possible changes or variations.

Because many varying and different embodiments may be made within the scope of the inventive concept herein taught, and because many modifications may be made in the embodiments herein detailed in accordance with the descriptive requirements of the law, it should be understood that the details herein are to be interpreted as illustrative and not in a limiting sense.

I claim:

1. A trenching device for use in preparing for the excavation of ditches, for use in conjunction with a hoe or similar excavation mechanism used for the excavation of such ditches, comprising:

an excavation box;

propulsion means for advancing said excavation box, said propulsion means being vertically and horizontally hingedly connected to said excavation box; and anchoring means for bracing said propulsion means against the walls of the already excavated portion of the ditch, said anchoring means being vertically and horizontally hingedly connected in said excavation box posteriorily of said excavation box.

2. A trenching device for use in preparing for the excavation of ditches and for subsequently reinforcing the ditches, and for use in conjunction with a hoe or similar excavation mechanism used for excavation and for use in conjunction with a pile driving apparatus for inserting piles along the walls of such trenches, comprising:

an excavation box;

propulsion means for advancing said excavation box, said propulsion means being vertically and horizontally hingedly connected to said excavation box; and anchoring means against the walls of the already excavated portion of the ditch, said anchoring means being vertically and horizontally hingedly connected to said excavation box posteriorily of said excavation box.

3. A trencher as in claim 1 or 2 wherein said excavation box includes a trolley beam structure which permits slideable relative motion between said advancing excavation box and said stationarily braced anchoring means during the expansion cycle of said propulsion means and said anchoring means as well as similar reverse relative motion between said stationary excavation box and said advancing anchoring means during the contraction cycle of said propulsion means and said anchoring means, said trolley beam structure extending behind said excavation box and including suspension means for connecting said anchoring means to said excavation box at various vertical positions.

4. A trencher as in claim 1 wherein said excavation box includes two thin sidewalls issuing in tapered front cutting edges and at least one spacer bar connecting, and being mounted substantially perpendicular to, both of said thin side walls in front of which said hoe or other external excavation mechanism scoops out the portion of dirt cut into by said tapered front edges of said excavation box as it advances propelled by the alternate application of said anchoring means and said propulsion means.

5. A trencher is in claim 4 wherein said excavation box includes cutting means, including a rotating vertical shaft, disposed within said tapered front cutting edges for tunneling through the portion of soil encountered by the front of said excavation box.

6. A trencher as in claim 5 wherein said cutting means include substantially rectangular cutting teeth mounted upon a shaft rotatably disposed within said tapered front cutting edges.

7. A trencher as in claim 6 wherein said cutting means include substantially trapezoidal cutting teeth mounted upon a shaft rotatably disposed within said tapered front cutting edges.

8. A trencher as in claim 2 wherein said excavation box includes two thin sidewalls issuing in tapered front cutting edges and at least one spacer bar connecting, and being mounted substantially perpendicular to, both of said thin side walls in front of which said hoe or other external excavation mechanism scoops out the portion of dirt cut into by said tapered front edges of said excavation box as it advances propelled by the alternate application of said anchoring means and said propulsion means.

9. A trencher as a claim 8 wherein said excavation box includes cutting means, including a rotating vertical shaft, disposed within said tapered front cutting edges for tunneling through the portion of soil encountered by the front of said excavation box.

10. A trencher as in claim 9 wherein said cutting means include substantially rectangular cutting teeth mounted upon a shaft rotatably disposed within said tapered front cutting edges.

11. A trencher as in claim 10 wherein said cutting means include substantially trapezoidal cutting teeth mounted upon a shaft rotatably disposed within said tapered front cutting edges.

12. A trencher as in claim 1 or 2 wherein said anchoring means and said propulsion means include at least one hydraulic piston and cylinder arrangement.

13. A trencher as in claim 2 wherein said two thin side walls issue at the end of said excavation box opposite said cutting edges into even thinner end sections or skirts so as to permit insertion of piling material inside said excavation box within, and substantially flush against the inside walls of, said thinner end section.

14. A trencher as in claim 1 or 2 wherein said excavation box includes two sets of said propulsion means and two sets of said anchoring means each set being separately vertically and horizontally hingedly connected to said excavation box and each set being separately adjustable vertically with respect to said excavation box and separately expandable and contractable, whereby it is possible to advance said excavation box in either a vertically inclined or declined line or progression.

15. A trencher as in claim 1 or 2 further comprising a plurality of said excavation boxes joined together in modular fashion by attaching one on top of the other so as to permit variations in the depth of the trenching operations.

* * * * *

UNITED STATES PATENT AND TRADEMARK OFFICE

CERTIFICATE OF CORRECTION

PATENT NO. : 4,279,548

DATED : July 21, 1981

INVENTOR(S) : Raymond W. Ramey

It is certified that error appears in the above—identified patent and that said Letters Patent is hereby corrected as shown below:

Column 3, line 48: Change "5" to -- 4 --.

Column 4, line 21; Change "for example" to -- for example, --.

Signed and Sealed this

*Twenty-second* Day of *December 1981*

[SEAL]

*Attest:*

GERALD J. MOSSINGHOFF

*Attesting Officer*

*Commissioner of Patents and Trademarks*